US008131550B2

(12) United States Patent
Nurminen et al.

(10) Patent No.: US 8,131,550 B2
(45) Date of Patent: Mar. 6, 2012

(54) METHOD, APPARATUS AND COMPUTER PROGRAM PRODUCT FOR PROVIDING IMPROVED VOICE CONVERSION

(75) Inventors: Jani Nurminen, Lempäälä (FI); Elina Helander, Tampere (FI)

(73) Assignee: Nokia Corporation, Espoo (FI)

( * ) Notice: Subject to any disclaimer, the term of this patent is extended or adjusted under 35 U.S.C. 154(b) by 1086 days.

(21) Appl. No.: 11/867,033

(22) Filed: Oct. 4, 2007

(65) Prior Publication Data

US 2009/0094027 A1 Apr. 9, 2009

(51) Int. Cl.
*G10L 13/00* (2006.01)

(52) U.S. Cl. ..... 704/260; 704/200; 704/241

(58) Field of Classification Search ..... 704/200, 704/241, 260

See application file for complete search history.

(56) References Cited

U.S. PATENT DOCUMENTS

| | | | | |
|---|---|---|---|---|
| 6,405,166 | B1 * | 6/2002 | Huang et al. | 704/246 |
| 6,615,174 | B1 * | 9/2003 | Arslan et al. | 704/270 |
| 7,580,839 | B2 * | 8/2009 | Tamura et al. | 704/258 |
| 2005/0137870 | A1 * | 6/2005 | Mizutani et al. | 704/264 |
| 2006/0178874 | A1 * | 8/2006 | En-Najjary et al. | 704/207 |
| 2006/0235685 | A1 * | 10/2006 | Nurminen et al. | 704/235 |
| 2007/0168189 | A1 * | 7/2007 | Tamura et al. | 704/235 |
| 2009/0094031 | A1 * | 4/2009 | Tian et al. | 704/251 |
| 2010/0198600 | A1 * | 8/2010 | Masuda | 704/278 |

OTHER PUBLICATIONS

Liu, K. et al., *High Quality Voice Conversion Through Combining Modified GMM and Formant Mapping for Mandarin*, Second International Conference on Digital Telecommunications, IEEE Computer Society, Jul. 2007, 6 pages.
En-Najjary, T. et al., *Fast GMM-Based Voice Conversion for Text-to-Speech Synthesis Systems*, Interspeech 2004, pp. 1229-1232.
Kain, A. et al., *Spectral Voice Conversion for Text-to-Speech Synthesis*, IEEE, vol. 1, May 1998, pp. 285-288.
Helander, E. et al., *LSF Mapping for Voice Conversion With Very Small Training Sets*, IEEE, Mar. 2008, pp. 4669-4672.
Sündermann, D. et al., *Residual Prediction Based on Unit Selection*, ASRU 2005, IEEE, pp. 369-374.
Dutoit, T. et al., *Towards a Voice Conversion System Based on Frame Selection*, ICASSP 2007, IEEE, pp. IV-513-516.
Helander, E. et al.,, *Analysis of LSF Frame Selection in Voice Conversion*, Nokia Technology Platforms, Tampere, Finland, 6 pages.
Paliwal, K. K. et al., *Efficient Vector Quantization of LPC Parameters*, IEEE Transactions of Speech and Audio Processing, vol. 1, No. 1, Jan. 1993, pp. 3-14.
First Office Action issued by The Patent Office of the People's Republic of China for Chinese Patent Application No. 200880110068.8, mailed May 25, 2011.

* cited by examiner

*Primary Examiner* — Daniel D Abebe
(74) *Attorney, Agent, or Firm* — Alston & Bird LLP

(57) ABSTRACT

An apparatus for providing improved voice conversion includes a sub-feature generator and a transformation element. The sub-feature generator may be configured to define sub-feature units with respect to a feature of source speech. The transformation element may be configured to perform voice conversion of the source speech to target speech based on the conversion of the sub-feature units to corresponding target speech sub-feature units using a conversion model trained with respect to converting training source speech sub-feature units to training target speech sub-feature units.

22 Claims, 5 Drawing Sheets

METHOD, APPARATUS AND COMPUTER PROGRAM PRODUCT FOR PROVIDING IMPROVED VOICE CONVERSION

TECHNOLOGICAL FIELD

Embodiments of the present invention relate generally to voice conversion and, more particularly, relate to a method, apparatus, and computer program product for providing improved voice conversion by employing sub-feature level processing.

BACKGROUND

The modern communications era has brought about a tremendous expansion of wireline and wireless networks. Computer networks, television networks, and telephony networks are experiencing an unprecedented technological expansion, fueled by consumer demand. Wireless and mobile networking technologies have addressed related consumer demands, while providing more flexibility and immediacy of information transfer.

Current and future networking technologies continue to facilitate ease of information transfer and convenience to users. One area in which there is a demand to increase ease of information transfer relates to the delivery of services to a user of a mobile terminal. The services may be in the form of a particular media or communication application desired by the user, such as a music player, a game player, an electronic book, short messages, email, etc. The services may also be in the form of interactive applications in which the user may respond to a network device in order to perform a task or achieve a goal. The services may be provided from a network server or other network device, or even from the mobile terminal such as, for example, a mobile telephone, a mobile television, a mobile gaming system, etc.

In many applications, it is necessary for the user to receive audio information such as oral feedback or instructions from the network. An example of such an application may be paying a bill, ordering a program, receiving driving instructions, etc. Furthermore, in some services, such as audio books, for example, the application is based almost entirely on receiving audio information. It is becoming more common for such audio information to be provided by computer generated voices. Accordingly, the user's experience in using such applications will largely depend on the quality and naturalness of the computer generated voice. As a result, much research and development has gone into speech processing techniques in an effort to improve the quality and naturalness of computer generated voices.

An example of speech processing includes voice conversion related applications in which the identity of a speaker may be changed. However, in order to train conversion models for performing this type of speech processing, it is typical for relatively large sets of training data comprising parallel sentences or utterances to be required, which can be undesirable since it may lead to increases in memory requirements and the recording of large training sets may be inconvenient and time-consuming for the users. Additionally, current techniques often suffer from over-smoothing and/or discontinuity problems.

Particularly in mobile environments, increases in memory consumption directly affect the cost of devices employing such methods. However, even in non-mobile environments, the possible increases in application footprints and memory consumption may not be desirable. Thus, a need exists for providing a mechanism for increasing the efficiency of voice conversion applications, while not sacrificing quality and accuracy.

BRIEF SUMMARY

A method, apparatus and computer program product are therefore provided to improve voice conversion efficiency. In particular, a method, apparatus and computer program product are provided that may perform voice conversion using models trained at a sub-feature level. Models may be trained, as a result, using less training data and therefore, more efficient voice conversion may be accomplished for a given quality level.

In one exemplary embodiment, a method of providing improved voice conversion is provided. The method may include defining sub-feature units with respect to a feature of source speech, and performing voice conversion of the source speech to target speech based on the conversion of the sub-feature units to corresponding target speech sub-feature units using a conversion model trained with respect to converting training source speech sub-feature units to training target speech sub-feature units.

In another exemplary embodiment, a computer program product for providing improved voice conversion is provided. The computer program product includes at least one computer-readable storage medium having computer-readable program code portions stored therein. The computer-readable program code portions include first and second executable portions. The first executable portion is for defining sub-feature units with respect to a feature of source speech. The second executable portion is for performing voice conversion of the source speech to target speech based on the conversion of the sub-feature units to corresponding target speech sub-feature units using a conversion model trained with respect to converting training source speech sub-feature units to training target speech sub-feature units.

In another exemplary embodiment, an apparatus for providing improved voice conversion is provided. The apparatus includes a sub-feature generator and a transformation element. The sub-feature generator may be configured to define sub-feature units with respect to a feature of source speech. The transformation element may be configured to perform voice conversion of the source speech to target speech based on the conversion of the sub-feature units to corresponding target speech sub-feature units using a conversion model trained with respect to converting training source speech sub-feature units to training target speech sub-feature units.

In another exemplary embodiment, an apparatus for providing improved voice conversion is provided. The apparatus includes means for defining sub-feature units with respect to a feature of source speech, and means for performing voice conversion of the source speech to target speech based on the conversion of the sub-feature units to corresponding target speech sub-feature units using a conversion model trained with respect to converting training source speech sub-feature units to training target speech sub-feature units.

In yet another exemplary embodiment, a method of training a transformation element for improved voice conversion is provided. The method includes determining, for a particular training source speech sub-feature sequence, a corresponding training target speech sub-feature sequence, and training a conversion model using the corresponding sub-feature sequences to perform voice conversion of source speech to target speech using the trained conversion model.

Embodiments of the invention may provide a method, apparatus and computer program product for advantageous employment in a speech processing. As a result, for example, mobile terminal users may enjoy enhanced usability and improved voice conversion capabilities without appreciably increasing memory and footprint requirements for the mobile terminal.

BRIEF DESCRIPTION OF THE SEVERAL VIEWS OF THE DRAWING(S)

Having thus described embodiments of the invention in general terms, reference will now be made to the accompanying drawings, which are not necessarily drawn to scale, and wherein:

DETAILED DESCRIPTION

Figure 1:
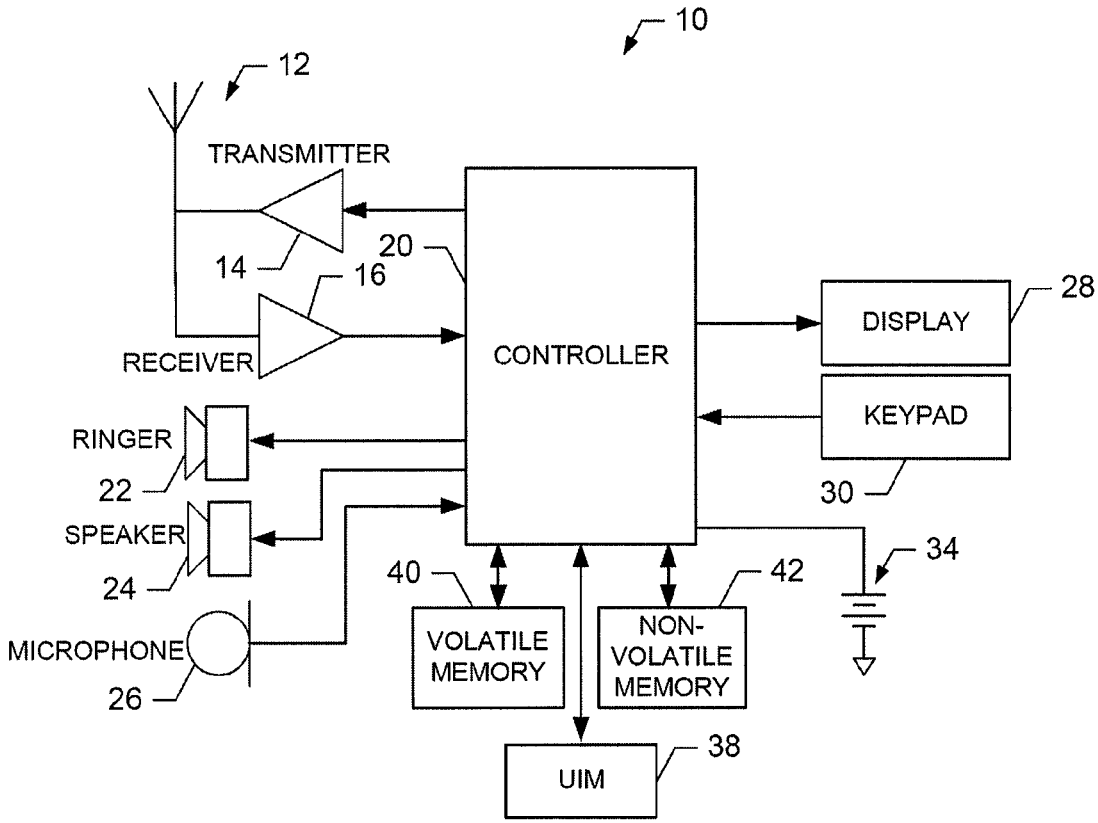
FIG. 1 is a schematic block diagram of a mobile terminal according to an exemplary embodiment of the present invention.

Embodiments of the present invention will now be described more fully hereinafter with reference to the accompanying drawings, in which some, but not all embodiments of the invention are shown. Indeed, embodiments of the invention may be embodied in many different forms and should not be construed as limited to the embodiments set forth herein; rather, these embodiments are provided so that this disclosure will satisfy applicable legal requirements. Like reference numerals refer to like elements throughout.

FIG. 1, one aspect of the invention, illustrates a block diagram of a mobile terminal 10 that would benefit from embodiments of the present invention. It should be understood, however, that a mobile telephone as illustrated and hereinafter described is merely illustrative of one type of mobile terminal that would benefit from embodiments of the present invention and, therefore, should not be taken to limit the scope of embodiments of the present invention. While several embodiments of the mobile terminal 10 are illustrated and will be hereinafter described for purposes of example, other types of mobile terminals, such as portable digital assistants (PDAs), pagers, mobile televisions, gaming devices, laptop computers, cameras, video recorders, audio/video player, radio, GPS devices, or any combination of the aforementioned, and other types of voice and text communications systems, can readily employ embodiments of the present invention.

In addition, while several embodiments of the method of the present invention are performed or used by a mobile terminal 10, the method may be employed by other than a mobile terminal. Moreover, the system and method of embodiments of the present invention will be primarily described in conjunction with mobile communications applications. It should be understood, however, that the system and method of embodiments of the present invention can be utilized in conjunction with a variety of other applications, both in the mobile communications industries and outside of the mobile communications industries.

The mobile terminal 10 includes an antenna 12 (or multiple antennae) in operable communication with a transmitter 14 and a receiver 16. The mobile terminal 10 may further include an apparatus, such as a controller 20 or other processing element, that provides signals to and receives signals from the transmitter 14 and receiver 16, respectively. The signals include signaling information in accordance with the air interface standard of the applicable cellular system, and also user speech, received data and/or user generated data. In this regard, the mobile terminal 10 is capable of operating with one or more air interface standards, communication protocols, modulation types, and access types. By way of illustration, the mobile terminal 10 is capable of operating in accordance with any of a number of first, second, third and/or fourth-generation communication protocols or the like. For example, the mobile terminal 10 may be capable of operating in accordance with second-generation (2G) wireless communication protocols IS-136 (time division multiple access (TDMA)), GSM (global system for mobile communication), and IS-95 (code division multiple access (CDMA)), or with third-generation (3G) wireless communication protocols, such as Universal Mobile Telecommunications System (UMTS), CDMA2000, wideband CDMA (WCDMA) and time division-synchronous CDMA (TD-SCDMA), with fourth-generation (4G) wireless communication protocols or the like. As an alternative (or additionally), the mobile terminal 10 may be capable of operating in accordance with non-cellular communication mechanisms. For example, the mobile terminal 10 may be capable of communication in a wireless local area network (WLAN) or other communication networks described below in connection with FIG. 2.

It is understood that the apparatus, such as the controller 20, may include circuitry desirable for implementing audio and logic functions of the mobile terminal 10. For example, the controller 20 may be comprised of a digital signal processor device, a microprocessor device, and various analog to digital converters, digital to analog converters, and other support circuits. Control and signal processing functions of the mobile terminal 10 are allocated between these devices according to their respective capabilities. The controller 20 thus may also include the functionality to convolutionally encode and interleave message and data prior to modulation and transmission. The controller 20 can additionally include an internal voice coder, and may include an internal data modem. Further, the controller 20 may include functionality to operate one or more software programs, which may be stored in memory. For example, the controller 20 may be capable of operating a connectivity program, such as a conventional Web browser. The connectivity program may then allow the mobile terminal 10 to transmit and receive Web content, such as location-based content and/or other web page content, according to a Wireless Application Protocol (WAP), Hypertext Transfer Protocol (HTTP) and/or the like, for example.

The mobile terminal 10 may also comprise a user interface including an output device such as a conventional earphone or speaker 24, a ringer 22, a microphone 26, a display 28, and a user input interface, all of which are coupled to the controller 20. The user input interface, which allows the mobile terminal 10 to receive data, may include any of a number of devices allowing the mobile terminal 10 to receive data, such as a keypad 30, a touch display (not shown) or other input device. In embodiments including the keypad 30, the keypad 30 may include the conventional numeric (0-9) and related keys (#, *), and other hard and soft keys used for operating the mobile terminal 10. Alternatively, the keypad 30 may include a conventional QWERTY keypad arrangement. The keypad 30 may also include various soft keys with associated functions. In addition, or alternatively, the mobile terminal 10 may include an interface device such as a joystick or other user input interface. The mobile terminal 10 further includes a battery 34, such as a vibrating battery pack, for powering various circuits that are required to operate the mobile terminal 10, as well as optionally providing mechanical vibration as a detectable output.

The mobile terminal 10 may further include a user identity module (UIM) 38. The UIM 38 is typically a memory device having a processor built in. The UIM 38 may include, for example, a subscriber identity module (SIM), a universal integrated circuit card (UICC), a universal subscriber identity module (USIM), a removable user identity module (R-UIM), etc. The UIM 38 typically stores information elements related to a mobile subscriber. In addition to the UIM 38, the mobile terminal 10 may be equipped with memory. For example, the mobile terminal 10 may include volatile memory 40, such as volatile Random Access Memory (RAM) including a cache area for the temporary storage of data. The mobile terminal 10 may also include other non-volatile memory 42, which can be embedded and/or may be removable. The non-volatile memory 42 can additionally or alternatively comprise an electrically erasable programmable read only memory (EEPROM), flash memory or the like, such as that available from the SanDisk Corporation of Sunnyvale, Calif., or Lexar Media Inc. of Fremont, Calif. The memories can store any of a number of pieces of information, and data, used by the mobile terminal 10 to implement the functions of the mobile terminal 10. For example, the memories can include an identifier, such as an international mobile equipment identification (IMEI) code, capable of uniquely identifying the mobile terminal 10. Furthermore, the memories may store instructions for determining cell id information. Specifically, the memories may store an application program for execution by the controller 20, which determines an identity of the current cell, i.e., cell id identity or cell id information, with which the mobile terminal 10 is in communication.

Figure 2:
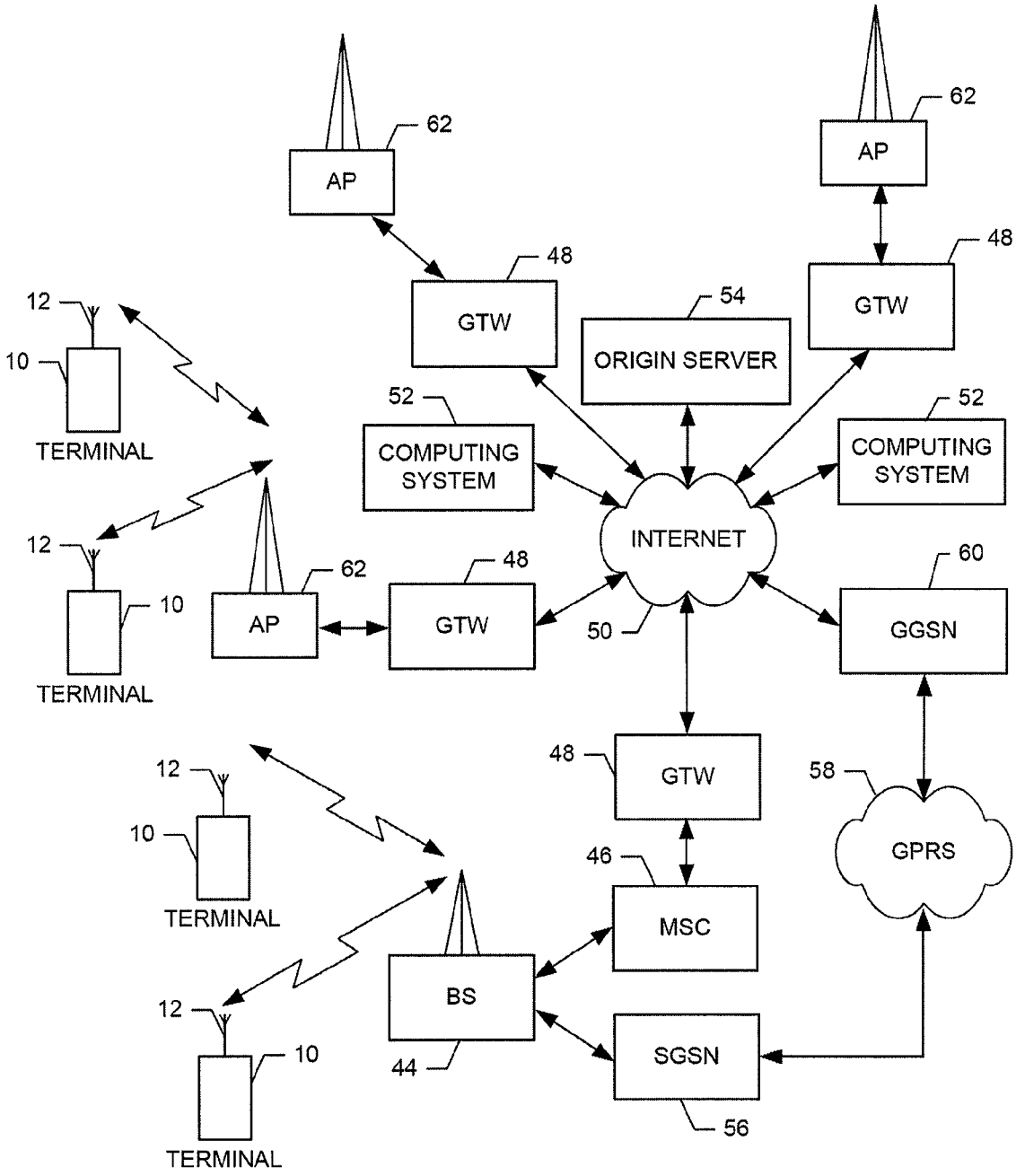
FIG. 2 is a schematic block diagram of a wireless communications system according to an exemplary embodiment of the present invention.

FIG. 2 is a schematic block diagram of a wireless communications system according to an exemplary embodiment of the present invention. Referring now to FIG. 2, an illustration of one type of system that would benefit from embodiments of the present invention is provided. The system includes a plurality of network devices. As shown, one or more mobile terminals 10 may each include an antenna 12 for transmitting signals to and for receiving signals from a base site or base station (BS) 44. The base station 44 may be a part of one or more cellular or mobile networks each of which includes elements required to operate the network, such as a mobile switching center (MSC) 46. As well known to those skilled in the art, the mobile network may also be referred to as a Base Station/MSC/Interworking function (BMI). In operation, the MSC 46 is capable of routing calls to and from the mobile terminal 10 when the mobile terminal 10 is making and receiving calls. The MSC 46 can also provide a connection to landline trunks when the mobile terminal 10 is involved in a call. In addition, the MSC 46 can be capable of controlling the forwarding of messages to and from the mobile terminal 10, and can also control the forwarding of messages for the mobile terminal 10 to and from a messaging center. It should be noted that although the MSC 46 is shown in the system of FIG. 2, the MSC 46 is merely an exemplary network device and embodiments of the present invention are not limited to use in a network employing an MSC.

The MSC 46 can be coupled to a data network, such as a local area network (LAN), a metropolitan area network (MAN), and/or a wide area network (WAN). The MSC 46 can be directly coupled to the data network. In one typical embodiment, however, the MSC 46 is coupled to a gateway device (GTW) 48, and the GTW 48 is coupled to a WAN, such as the Internet 50. In turn, devices such as processing elements (e.g., personal computers, server computers or the like) can be coupled to the mobile terminal 10 via the Internet 50. For example, as explained below, the processing elements can include one or more processing elements associated with a computing system 52 (two shown in FIG. 2), origin server 54 (one shown in FIG. 2) or the like, as described below.

The BS 44 can also be coupled to a serving GPRS (General Packet Radio Service) support node (SGSN) 56. As known to those skilled in the art, the SGSN 56 is typically capable of performing functions similar to the MSC 46 for packet switched services. The SGSN 56, like the MSC 46, can be coupled to a data network, such as the Internet 50. The SGSN 56 can be directly coupled to the data network. In a more typical embodiment, however, the SGSN 56 is coupled to a packet-switched core network, such as a GPRS core network 58. The packet-switched core network is then coupled to another GTW 48, such as a gateway GPRS support node (GGSN) 60, and the GGSN 60 is coupled to the Internet 50. In addition to the GGSN 60, the packet-switched core network can also be coupled to a GTW 48. Also, the GGSN 60 can be coupled to a messaging center. In this regard, the GGSN 60 and the SGSN 56, like the MSC 46, may be capable of controlling the forwarding of messages, such as MMS messages. The GGSN 60 and SGSN 56 may also be capable of controlling the forwarding of messages for the mobile terminal 10 to and from the messaging center.

In addition, by coupling the SGSN 56 to the GPRS core network 58 and the GGSN 60, devices such as a computing system 52 and/or origin server 54 may be coupled to the mobile terminal 10 via the Internet 50, SGSN 56 and GGSN 60. In this regard, devices such as the computing system 52 and/or origin server 54 may communicate with the mobile terminal 10 across the SGSN 56, GPRS core network 58 and the GGSN 60. By directly or indirectly connecting mobile terminals 10 and the other devices (e.g., computing system 52, origin server 54, etc.) to the Internet 50, the mobile terminals 10 may communicate with the other devices and with one another, such as according to the Hypertext Transfer Protocol (HTTP) and/or the like, to thereby carry out various functions of the mobile terminals 10.

Although not every element of every possible mobile network is shown and described herein, it should be appreciated that the mobile terminal 10 may be coupled to one or more of any of a number of different networks through the BS 44. In this regard, the network(s) may be capable of supporting communication in accordance with any one or more of a number of first-generation (1G), second-generation (2G), 2.5G, third-generation (3G), 3.9G, fourth-generation (4G) mobile communication protocols or the like. For example, one or more of the network(s) can be capable of supporting communication in accordance with 2G wireless communication protocols IS-136 (TDMA), GSM, and IS-95 (CDMA). Also, for example, one or more of the network(s) can be capable of supporting communication in accordance with 2.5G wireless communication protocols GPRS, Enhanced Data GSM Environment (EDGE), or the like. Further, for example, one or more of the network(s) can be capable of supporting communication in accordance with 3G wireless communication protocols such as a UMTS network employing WCDMA radio access technology. Some narrow-band analog mobile phone service (NAMPS), as well as total access communication system (TACS), network(s) may also benefit from embodiments of the present invention, as should dual or higher mode mobile stations (e.g., digital/analog or TDMA/CDMA/analog phones).

The mobile terminal 10 can further be coupled to one or more wireless access points (APs) 62. The APs 62 may comprise access points configured to communicate with the mobile terminal 10 in accordance with techniques such as, for example, radio frequency (RF), infrared (IrDA) or any of a number of different wireless networking techniques, including WLAN techniques such as IEEE 802.11 (e.g., 802.11a, 802.11b, 802.11g, 802.11n, etc.), world interoperability for microwave access (WiMAX) techniques such as IEEE 802.16, and/or wireless Personal Area Network (WPAN) techniques such as IEEE 802.15, BlueTooth (BT), ultra wideband (UWB) and/or the like. The APs 62 may be coupled to the Internet 50. Like with the MSC 46, the APs 62 can be directly coupled to the Internet 50. In one embodiment, however, the APs 62 are indirectly coupled to the Internet 50 via a GTW 48. Furthermore, in one embodiment, the BS 44 may be considered as another AP 62. As will be appreciated, by directly or indirectly connecting the mobile terminals 10 and the computing system 52, the origin server 54, and/or any of a number of other devices, to the Internet 50, the mobile terminals 10 can communicate with one another, the computing system, etc., to thereby carry out various functions of the mobile terminals 10, such as to transmit data, content or the like to, and/or receive content, data or the like from, the computing system 52. As used herein, the terms "data," "content," "information" and similar terms may be used interchangeably to refer to data capable of being transmitted, received and/or stored in accordance with embodiments of the present invention. Thus, use of any such terms should not be taken to limit the spirit and scope of embodiments of the present invention.

Although not shown in FIG. 2, in addition to or in lieu of coupling the mobile terminal 10 to computing systems 52 across the Internet 50, the mobile terminal 10 and computing system 52 may be coupled to one another and communicate in accordance with, for example, RF, BT, IrDA or any of a number of different wireline or wireless communication techniques, including LAN, WLAN, WiMAX, UWB techniques and/or the like. One or more of the computing systems 52 can additionally, or alternatively, include a removable memory capable of storing content, which can thereafter be transferred to the mobile terminal 10. Further, the mobile terminal 10 can be coupled to one or more electronic devices, such as printers, digital projectors and/or other multimedia capturing, producing and/or storing devices (e.g., other terminals). Like with the computing systems 52, the mobile terminal 10 may be configured to communicate with the portable electronic devices in accordance with techniques such as, for example, RF, BT, IrDA or any of a number of different wireline or wireless communication techniques, including universal serial bus (USB), LAN, WLAN, WiMAX, UWB techniques and/or the like.

In an exemplary embodiment, content or data may be communicated over the system of FIG. 2 between a mobile terminal, which may be similar to the mobile terminal 10 of FIG. 1, and a network device of the system of FIG. 2 in order to, for example, execute applications or establish communication (e.g., for voice communication, receipt or provision of oral instructions, etc.) between the mobile terminal 10 and other mobile terminals or network devices. However, it should be understood that the system of FIG. 2 need not be employed for communication between mobile terminals or between a network device and the mobile terminal, but rather FIG. 2 is merely provided for purposes of example. Furthermore, it should be understood that embodiments of the present invention may be resident on a communication device such as the mobile terminal 10, and/or may be resident on other devices, absent any communication with the system of FIG. 2.

Figure 3:
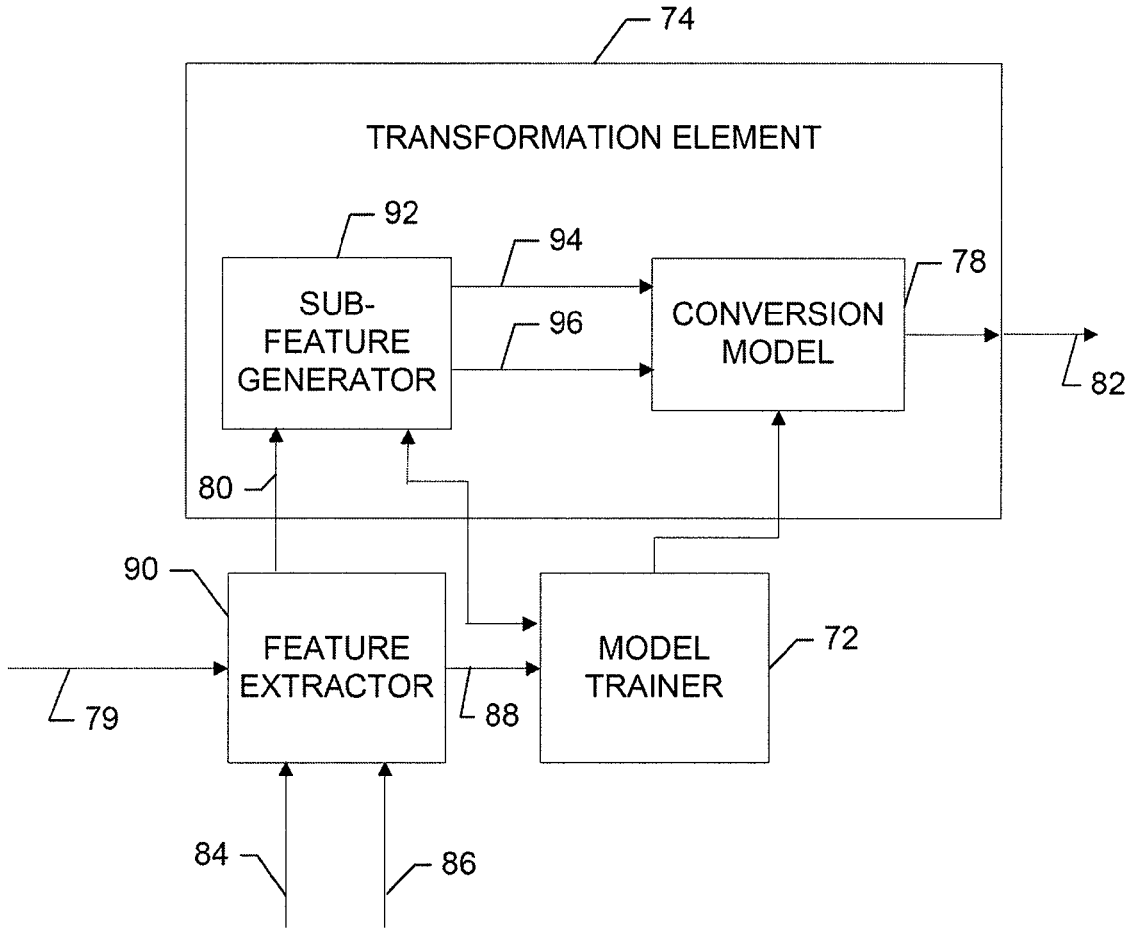
FIG. 3 illustrates a block diagram of portions of an apparatus for providing improved voice conversion according to an exemplary embodiment of the present invention.

An exemplary embodiment of the invention will now be described with reference to FIG. 3, in which certain elements of an apparatus for providing improved voice conversion are displayed. The apparatus of FIG. 3 may be employed, for example, on the mobile terminal 10 of FIG. 1 and/or the computing system 52 or the origin server 54 of FIG. 2. However, it should be noted that the system of FIG. 3, may also be employed on a variety of other devices, both mobile and fixed, and therefore, the present invention should not be limited to application on devices such as the mobile terminal 10 of FIG. 1. It should also be noted, however, that while FIG. 3 illustrates one example of a configuration of an apparatus for providing improved data compression, numerous other configurations may also be used to implement the present invention. Furthermore, although FIG. 3 will be described in the context of one possible implementation, embodiments of the present invention need not necessarily be practiced using the mentioned techniques, but instead other conversion techniques (e.g., codebooks or neural networks) could alternatively be employed. Thus, embodiments of the present invention may be practiced in exemplary applications such as, for example, in the context of voice or sound generation in gaming devices, voice conversion in chatting or other applications in which it is desirable to hide the identity of the speaker, translation applications, etc.

Referring now to FIG. 3, an apparatus for providing voice conversion is provided. The apparatus may include a model trainer 72 and a transformation element 74. Each of the model trainer 72 and the transformation element 74 may be any device or means embodied in either hardware, software, or a combination of hardware and software capable of performing the respective functions associated with each of the corresponding elements as described below. In an exemplary embodiment, the model trainer 72 and the transformation element 74 are embodied in software as instructions that are stored on a memory of the mobile terminal 10 and executed by the controller 20. However, each of the elements above may alternatively operate under the control of a corresponding local processing element or a processing element of another device not shown in FIG. 3. A processing element such as those described above may be embodied in many ways. For example, the processing element may be embodied as a processor, a coprocessor, a controller or various other processing means or devices including integrated circuits such as, for example, an ASIC (application specific integrated circuit). It should be noted that although FIG. 3 illustrates the model trainer 72 as being a separate element from the transformation element 74, the model trainer 72 and the transformation element 74 may also be collocated or embodied in a single element or device capable of performing the functions of both the model trainer 72 and the transformation element 74.

As indicated in FIG. 3, the apparatus may be configured to convert source speech 79 into converted target speech 82. In this regard, the source speech 79 may be provided from any of numerous sources such as a particular speaker or even from synthetic speech which may be generated by a text-to-speech (TTS) device. In an exemplary embodiment, the model trainer 72 may be utilized to train the transformation element 74 for conversion of the source speech 79 into the converted target speech 82. In this regard, for example, the transformation element 74 may include a conversion model 78 that may include a conversion function determined for converting source speech features into corresponding target speech features based on parallel source and target speech training data sets. Embodiments of the present invention generally provide a mechanism by which to improve efficiency with respect to such conversion (e.g., by providing a smaller conversion model that may be created with less data).

Embodiments of the present invention generally employ two phases of operation. In this regard, during a training phase, the conversion model 78 is trained, using training data, to convert training source speech into training target speech. However, in accordance with embodiments of the present invention, the conversion model 78 is trained at a sub-feature level. After the conversion model 78 has been trained, the conversion model 78 may be utilized to perform conversion between source speech and target speech during a conversion phase.

The source speech 79, when received during the conversion phase, may be communicated to a feature extractor 90. The feature extractor 90 may be any device or means embodied in either hardware, software, or a combination of hardware and software capable of extracting data corresponding to a particular feature or property from a data set. One example of a feature that may be extracted from the data set may be line spectral frequency (LSF) information representing the spectral envelope of the vocal tract of the source speaker. Features extracted from the source speech 79 may then be converted into corresponding target speech features by the conversion model 78 in order to produce the converted target speech 82. However, as indicated above, the conversion may actually take place at a sub-feature level as described in greater detail below. The feature extractor 90 may similarly extract features from the training data as also described below in greater detail.

The conversion model 78 may be embodied, for example, using unit selection or as a trained Gaussian Mixture Model (GMM) for transforming source speech features (or sub-features) into corresponding target speech features (or sub-features) as provided below. In this regard, training source speech 84 and training target speech 86 (which may comprise the training data) may be utilized for training the conversion model 78 during the training phase. More specifically, the training source speech 84 and the training target speech 86 may include parallel sentences or utterances associated with source and target speakers, respectively. The parallel sentences or utterances may be stored in a database or other memory location accessible to the model trainer 72. The model trainer 72 may then utilize specific features associated with the training source speech 84 and corresponding features of the training target speech 86 (as provided by the feature extractor 90) to determine a conversion function (thereby training the conversion model 78) for transforming features of the training source speech 84 into corresponding features of the training target speech 86. The conversion model 78 may thereafter be utilized to convert the source speech 79, which may be, for example, spoken freely, into corresponding converted target speech 82 during the conversion phase.

In an exemplary embodiment, the feature extractor 90 may receive each of the source speech 79 (during a conversion), the training source speech 84 (during model training) and the training target speech 86 (during model training) and extract features from each of the source speech 79, the training source speech 84 and the training target speech 88, respectively. In this regard, source speech features 80 (e.g., LSF features) may be extracted from the source speech 79 and training source speech features and training target speech features, which may collectively be referred to as training feature data 88, may be extracted from the training source speech 84 and the training target speech 86, respectively.

In a conventional voice conversion application, the training feature data 88 may be utilized for training the conversion model 78 to transform the source speech features 80 into corresponding target speech features for use in producing the converted target speech during a conversion operation. However, in accordance with embodiments of the present invention, the training of the conversion model 78 and the subsequent conversion of source speech to target speech during voice conversion operations may be performed at the sub-feature level. Accordingly, embodiments of the present invention may include a sub-feature generator 92. The sub-feature generator 92 may be any device or means embodied in either hardware, software, or a combination of hardware and software capable of determining sub-features from the training feature data 88 and/or the source speech features 80 thereby enabling conversion operations at the sub-feature level. In this regard, for example, if a particular feature (e.g., corresponding to any of the source speech features 80 or the source or target components of the training feature data 88) included ten different LSF elements (e.g., LSFs 1-10), the sub-feature generator 92 may be configured to divide the particular feature into sub-features including different groups of the LSFs. For example, if it is desired to split the feature into three sub-feature parts, the sub-feature generator 92 may be trained (e.g., by the model trainer 72) to define LSFs 1-3 as corresponding to a first sub-feature, LSFs 4-6 as corresponding to a second sub-feature, and LSFs 7-10 as corresponding to a third sub-feature. It should be noted that, in an exemplary embodiment, the sub-features could overlap. In other words, for example, LSFs 1-3 could correspond to the first sub-feature, LSFs 3-6 could correspond to the second sub-feature, and LSFs 6-10 could correspond to the third sub-feature. In addition, the non-neighboring elements can be taken into the sub-features if that seems a good choice in the training. For example, LSFs 1-2 and 4 could correspond to the first sub-feature, LSFs 3-7 could correspond to the second sub-feature, and LSFs 6 and 8-10 could correspond to the third sub-feature.

In some embodiments, the features may be considered in terms of data frames that may be on the order of about 10 ms in length. Accordingly, the sub-features may be considered as sub-frames in such embodiments. The frame and sub-frame sizes are typically consistent in size for a given application. However, it may be desirable under certain circumstances to define the frames and/or sub-frames to have variable sizes. In an exemplary embodiment, the training data may be stored either as raw speech (e.g., as training source speech 84 and/or training target speech 86), as corresponding source and training feature sets (e.g., as the training feature data 88) or as a collection of sub-features (or sub-frames) in a database or memory accessible to the apparatus.

During training of the transformation element 74 by the model trainer 72, the model trainer 72 may align the parallel utterances used for training in a frame-wise manner. The alignment may be carried out using standard dynamic time warping (DTW) based techniques or other techniques such as, for example, hidden Markov model (HMM) based techniques. Alignment using DTW may result in some frame pairs being ignored while searching for an optimal path in terms of a global minimum. By virtue of the alignment, a sub-frame of a particular training source speech feature may be associated with a best-matching sub-frame of the training target speech feature. Accordingly, a best matching sub-frame within a training target speech feature set may be found for each sub-frame within a training source speech feature set. In other words, in the context of LSF features, for example, the database storing sub-feature data may be searched for a given source sub-feature set of LSF data to find the corresponding target sub-feature set of LSF data (obtained by the alignment) and the corresponding sub-feature sets may be used for training the conversion model 78.

Since there may almost always be at least small errors with respect to alignment of sub-features, and since it may be desirable to maintain the natural alignment of adjacent features, the sub-feature generator 92 may take natural continuity between frames in account when determining the sub-features (e.g., which LSF groups form a sub-feature or sub-frame). As such, whole frames and neighboring frames may be considered when choosing a sub-frame. Accordingly, frames that are "unlikely" (e.g., LSFs that are too close to each other in frequency domain) may be avoided.

The sub-feature generator 92 may also be trained during the training phase, for example, by the model trainer 72. In this regard, for example, the sub-feature generator 92 may be trained to split features or frames based on correlations in the training data. For example, correlation coefficients may be measured for each LSF (e.g., of LSFs 1-10) and those that show higher correlation may be grouped together to form a sub-feature for feature splitting to the sub-feature generator 92. The correlations may be computed separately for source and target data or for joint source-target pairs. Selection of sub-frame size could be made, for example, based on efforts to minimize a spectral distortion (SD) measure with respect to the frames. In this regard, the selection of the sub-frame size may be similar to codebook based quantization insofar as a speaker database may act as a codebook for testing a sentence. In speech coding, the following quality measures have been generally accepted as limits for transparent quality (e.g., quality that is perceptually indistinguishable from clean speech):

The mean spectral distortion is below 1 dB;

The percentage of 2 dB outliers is less than 2%; and

There are no 4 dB outliers.

The conversion model 78 may be implemented using any applicable conversion technique. For example, it could be based solely on GMMs or it could utilize linear transforms, neural networks, codebooks or unit selection based techniques. Unit selection based model can be realized using split units. Several candidate sub-feature units can be chosen for each split and neighboring frames can be taken into account using dynamic programming for selecting the best sub-feature sequences. A GMM or some other model for preselection may also be used to aid in the unit selection with split units to reduce the search space. In an exemplary embodiment, an iterative process for tuning the conversion model 78 and/or the sub-feature generator 92 may be employed. In this regard, for example, once a conversion has been performed, revisions and corresponding retraining of the conversion model 78 and/or the sub-feature generator 92 may be utilized to provide data for use in accessing and modifying the training phase. In an exemplary embodiment, clustering of LSFs may be possible through quality measures used in speech coding in order to reduce required storage space for practicing embodiments of the present invention.

A description of operation of an exemplary embodiment will now be provided in reference to FIG. 3. In this regard, during the training phase, the training feature data 88 may be communicated to the model trainer 72. The model trainer 72 may communicate with the sub-feature generator 92 to train the sub-feature generator 92 with respect to defining sub-features or sub-frames with respect to the training feature data in order to produce sub-frame data 94, which may be returned to the model trainer 72 to then be communicated to the conversion model 78. Alternatively, the sub-feature data 94 may be communicated directly to the conversion model 78 under the control of the model trainer 72 as shown in FIG. 3. The sub-feature data 94 may include aligned sub-frames or sub-features from the training source and target feature data of the training feature data 88, which may be used by the conversion model 78 to determine a conversion function for converting between source and target sub-frames or sub-features. Then during the conversion phase, the source speech 79 may have features extracted to form the source speech features 80 that may be split into source speech sub-features 96 that may be converted to corresponding target speech sub-features by the previously trained conversion model 78 and the transformation element 74 may output corresponding converted target speech 82 (which may be produced by speech synthesis).

Accordingly, in the context of voice conversion using TTS, if there are many TTS voices available, it may be possible to measure which of the TTS voices that are available is able to provide the best quality for voice conversion by training the conversion process as indicated above. When a TTS voice is used as the source speaker, noise is generally not problematic so the process may not be affected much, even in noisy environments. Moreover, it may also be desirable to practice embodiments of the present invention on residual spectrum data in addition to the spectral envelope.

Embodiments of the present invention may provide high efficiency with relatively high accuracy for a reasonably small footprint and relatively low computational load. Moreover, embodiments may operate with smaller database sizes than conventional techniques, which may reduce the burden on a user to record numerous training sentences. Embodiments of the present invention may also provide a flexible and scalable solution that may be adjusted to various use cases and complexity levels and can be optimized for different speakers and speaker pairs. Furthermore, embodiments of the present invention are fully data-driven and therefore do not require any language-specific knowledge. Accordingly, over-smoothing and/or discontinuity problems of conventional techniques may be reduced or avoided.

In a practical example, which is provided only for purposes of example and not of limitation, an embodiment of the sub-feature based approach was compared to conventional full-vector approach for a comparison with respect to transparent quality standards for performance over a range of training sentence set sizes. Results of the comparison are shown in Table 1 below. In this regard, for each set size in terms of number of sentences in the training data set, a comparison of scores for the conventional full vectors (on the left) and sub-features of an embodiment of the present invention (on the right) is provided.

TABLE 1

| | Transparent | 5 sentences | 10 sentences | 20 sentences | 50 sentences | 100 sentences |
|---|---|---|---|---|---|---|
| Mean SD (dB) | <1.00 | 2.23\|0.80 | 2.00\|0.63 | 1.80\|0.51 | 1.59\|0.38 | 1.46\|0.31 |
| 2 dB outliers (%) | <2.00 | 58.5\|1.57 | 46.1\|0.47 | 34.7\|0.15 | 21.4\|0.03 | 14.0\|0.01 |
| 4 dB outliers (%) | 0 | 2.63\|0.05 | 0.95\|0* | 0.38\|0 | 0.10\|0 | 0.04\|0 |

*0.0032% of outliers (3 frames in 93513 frames)

As can be seen from Table 1, even for relatively small set sizes (e.g., low numbers of sentences), transparent quality can be achieved using sub-features of an embodiment of the present invention. Accordingly, it can be further appreciated that embodiments of the present invention may provide more efficient conversion with smaller conversion models produced with less data.

Figure 4:
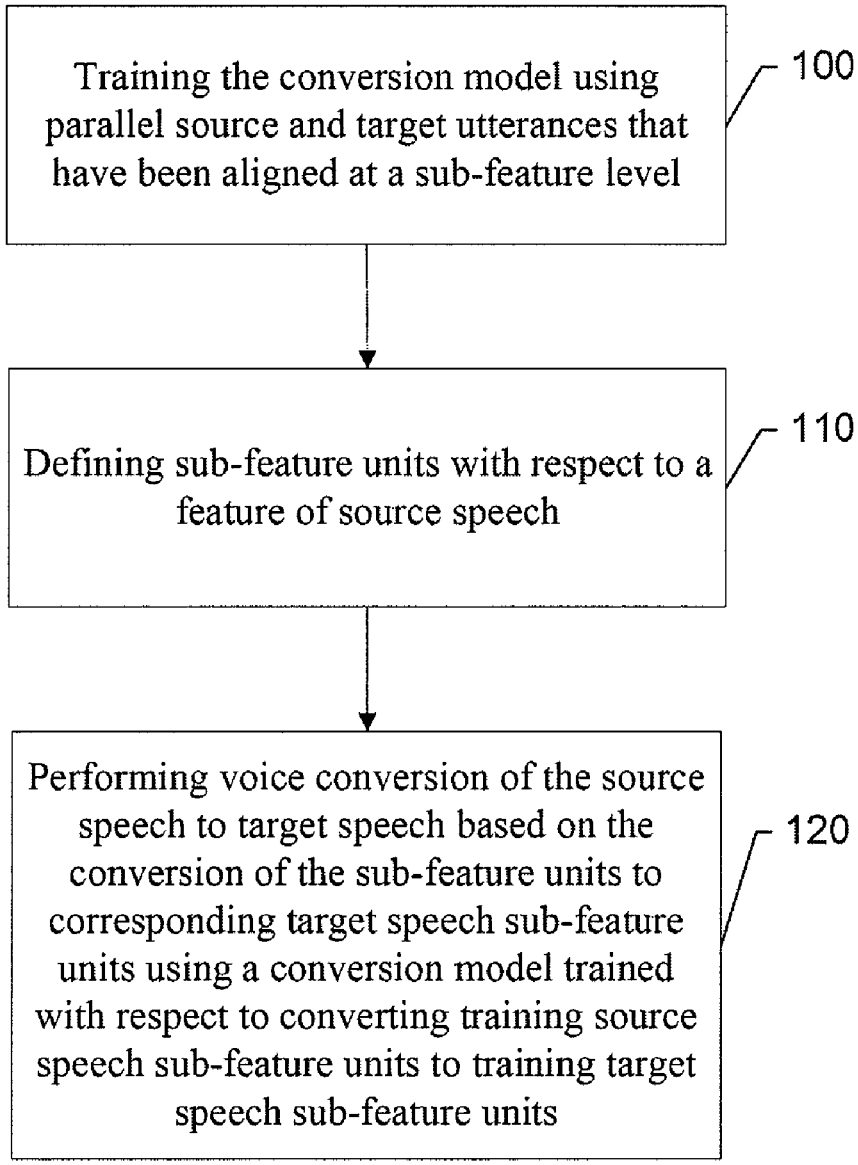
FIG. 4 is a block diagram according to an exemplary method for improved voice conversion according to an exemplary embodiment of the present invention.
Figure 5:
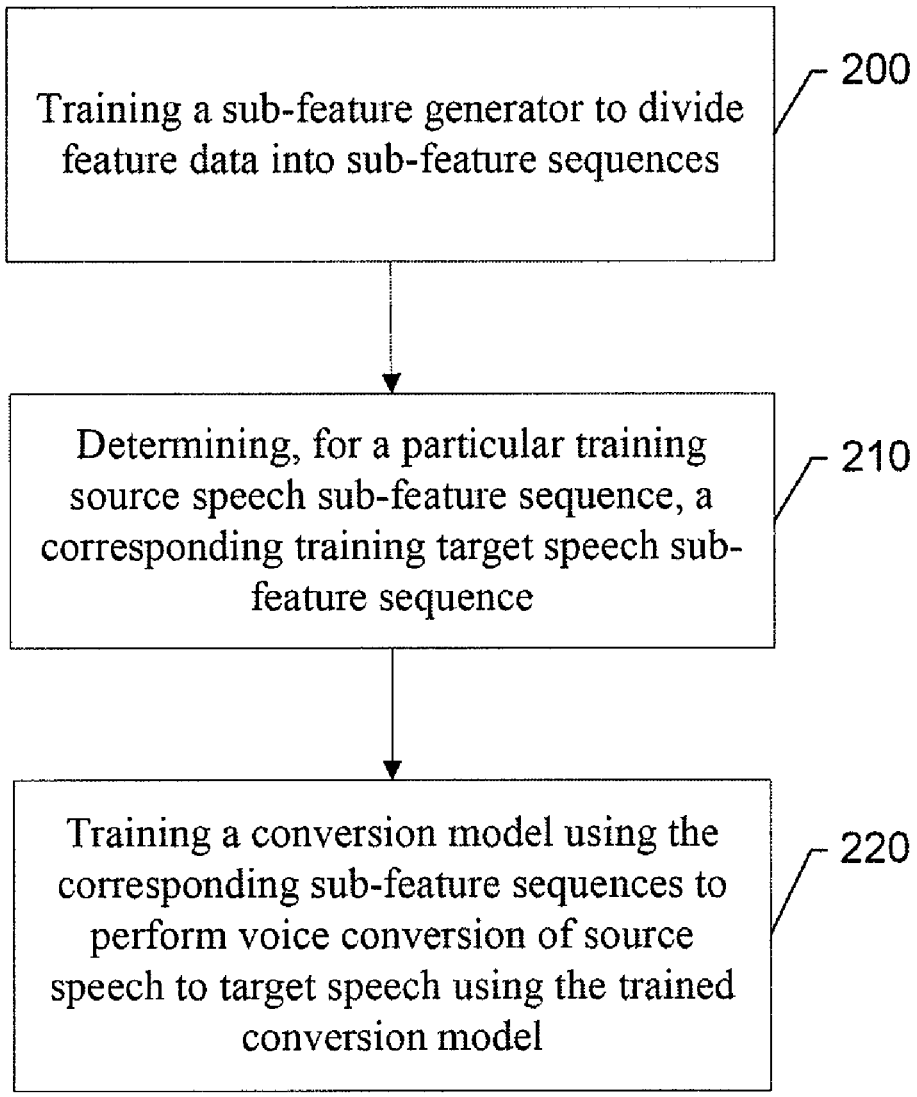
FIG. 5 is a block diagram according to another exemplary method for training a transformation element according to an exemplary embodiment of the present invention.

FIGS. 4 and 5 are flowcharts of a system, method and program product according to exemplary embodiments of the invention. It will be understood that each block or step of the flowcharts, and combinations of blocks in the flowcharts, can be implemented by various means, such as hardware, firmware, and/or software including one or more computer program instructions. For example, one or more of the procedures described above may be embodied by computer program instructions. In this regard, the computer program instructions which embody the procedures described above may be stored by a memory device of the mobile terminal and executed by a built-in processor in the mobile terminal. As will be appreciated, any such computer program instructions may be loaded onto a computer or other programmable apparatus (i.e., hardware) to produce a machine, such that the instructions which execute on the computer or other programmable apparatus create means for implementing the functions specified in the flowcharts block(s) or step(s). These computer program instructions may also be stored in a computer-readable memory that can direct a computer or other programmable apparatus to function in a particular manner, such that the instructions stored in the computer-readable memory produce an article of manufacture including instruction means which implement the function specified in the flowcharts block(s) or step(s). The computer program instructions may also be loaded onto a computer or other programmable apparatus to cause a series of operational steps to be performed on the computer or other programmable apparatus to produce a computer-implemented process such that the instructions which execute on the computer or other programmable apparatus provide steps for implementing the functions specified in the flowcharts block(s) or step(s).

Accordingly, blocks or steps of the flowcharts support combinations of means for performing the specified functions, combinations of steps for performing the specified functions and program instruction means for performing the specified functions. It will also be understood that one or more blocks or steps of the flowcharts, and combinations of blocks or steps in the flowcharts, can be implemented by special purpose hardware-based computer systems which perform the specified functions or steps, or combinations of special purpose hardware and computer instructions.

In this regard, one embodiment of a method of providing improved voice conversion, as shown in FIG. 4, includes defining sub-feature units with respect to a feature of source speech at operation 110. In an exemplary embodiment, defining the sub-feature units may include selecting sub-feature units using a sub-feature generator trained to define the sub-feature units based on correlations within the feature. At operation 120, a voice conversion of the source speech to target speech may be performed based on the conversion of the sub-feature units to corresponding target speech sub-feature units using a conversion model trained with respect to converting training source speech sub-feature units to training target speech sub-feature units.

The conversion model may be pre-trained or, in an exemplary embodiment, the method may further include an optional initial operation of training the conversion model using parallel source and target utterances that have been aligned at a sub-feature level at operation 100. Other optional operations may include tuning the sub-feature generator and/or the conversion model based on iterative conversion and training operations or selecting the source speech from a plurality of synthetic voices based on the target speech. In an exemplary embodiment, the method may also include, for a particular training source speech sub-feature sequence, searching a database to identify a corresponding training target speech sub-feature sequence, wherein the conversion model is trained using the corresponding sub-feature sequences.

FIG. 5 illustrates an exemplary embodiment of a method for training a transformation element including the conversion model. As illustrated in FIG. 5, the method may include an optional initial operation of training a sub-feature generator to divide feature data into sub-features at operation 200. At operation 210, for a particular training source speech sub-feature sequence, a corresponding training target speech sub-feature sequence may be determined. A conversion model may then be trained using the corresponding sub-feature sequences to perform voice conversion of source speech to target speech using the trained conversion model.

Many modifications and other embodiments of the inventions set forth herein will come to mind to one skilled in the art to which these embodiments pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method comprising:

extracting a feature indicative of a property of a vocal tract of a speaker from each of training source speech and training target speech;

defining sub-feature units with respect to the feature for both the training source speech and the training target speech to generate training source speech sub-feature units and training target speech sub-feature units, respectively; and performing voice conversion of source speech to target speech based on the conversion of the sub-feature units to corresponding target speech sub-feature units using a conversion model trained with respect to converting the training source speech sub-feature units to the training target speech sub-feature units.

2. A method according to claim 1, further comprising an initial operation of training the conversion model using parallel source and target utterances that have been aligned at a sub-feature level.

3. A method according to claim 1, wherein defining the sub-feature units comprises selecting sub-feature units using a sub-feature generator trained to define the sub-feature units based on correlations within the feature.

4. A method according to claim 3, further comprising tuning the sub-feature generator or the conversion model based on iterative conversion and training operations.

5. A method according to claim 1, further comprising selecting the source speech from a plurality of synthetic voices based on the target speech.

6. A method according to claim 1, further comprising, for a particular training source speech sub-feature sequence, searching a database to identify a corresponding training target speech sub-feature sequence, wherein the conversion model is trained using the corresponding sub-feature sequences.

7. A method according to claim 1 wherein voice conversion of source speech to target speech is performed using a processor.

8. A computer program product comprising at least one computer-readable storage medium having computer-readable program code portions stored therein, the computer-readable program code portions comprising:

a first executable portion for extracting a feature indicative of a property of a vocal tract of a speaker from each of training source speech and training target speech;

a second executable portion for defining sub-feature units with respect to the feature for both the training source speech and the training target speech to generate training source speech sub-feature units and training target speech sub-feature units, respectively; and a third executable portion for performing voice conversion of source speech to target speech based on the conversion of the sub-feature units to corresponding target speech sub-feature units using a conversion model trained with respect to converting the training source speech sub-feature units to the training target speech sub-feature units.

9. A computer program product according to claim 8, further comprising a fourth executable portion for an initial operation of training the conversion model using parallel source and target utterances that have been aligned at a sub-feature level.

10. A computer program product according to claim 8, wherein the first executable portion includes instructions for selecting sub-feature units using a sub-feature generator trained to define the sub-feature units based on correlations within the feature.

11. A computer program product according to claim 10, further comprising a fourth executable portion for tuning the sub-feature generator or the conversion model based on iterative conversion and training operations.

12. A computer program product according to claim 8, further comprising a fourth executable portion for selecting the source speech from a plurality of synthetic voices based on the target speech.

13. A computer program product according to claim 8, further comprising a fourth executable portion for searching a database, for a particular training source speech sub-feature sequence, to identify a corresponding training target speech sub-feature sequence, wherein the conversion model is trained using the corresponding sub-feature sequences.

14. An apparatus comprising a processor and memory including computer program code, the memory and the computer program code configured to, with the processor, cause the apparatus to at least:

extract a feature indicative of a property of a vocal tract of a speaker from each of training source speech and training target speech;

define sub-feature units with respect to the feature for both the training source speech and the training target speech to generate training source speech sub-feature units and training target speech sub-feature units, respectively; and perform voice conversion of source speech to target speech based on the conversion of the sub-feature units to corresponding target speech sub-feature units using a conversion model trained with respect to converting the training source speech sub-feature units to the training target speech sub-feature units.

15. An apparatus according to claim 14, wherein the memory and computer program code are further configured to, with the processor, cause the apparatus to perform an initial operation of training the conversion model using parallel source and target utterances that have been aligned at a sub-feature level.

16. An apparatus according to claim 14, wherein the memory and computer program code are further configured to, with the processor, cause the apparatus to select by defining the sub-feature units based on correlations within the feature.

17. An apparatus according to claim 16, wherein the memory and computer program code are further configured to, with the processor, cause the apparatus to be tuned based on iterative conversion and training operations.

18. An apparatus according to claim 14, wherein the source speech is selected from a plurality of synthetic voices based on the target speech.

19. An apparatus according to claim 14, further comprising a database storing training data in which, for a particular training source speech sub-feature sequence, the memory and computer program code are further configured to, with the processor, cause the apparatus to search the database to identify a corresponding training target speech sub-feature sequence, and wherein the conversion model is trained using the corresponding sub-feature sequences.

20. An apparatus comprising:

means for extracting a feature indicative of a property of a vocal tract of a speaker from each of training source speech and training target speech;

means for defining sub-feature units with respect to the feature for both the training source speech and the training target speech to generate training source speech sub-feature units and training target speech sub-feature units, respectively; and means for performing voice conversion of source speech to target speech based on the conversion of the sub-feature units to corresponding target speech sub-feature units using a conversion model trained with respect to converting the training source speech sub-feature units to the training target speech sub-feature units.

21. An apparatus according to claim 20, wherein means for defining the sub-feature units comprises means for selecting sub-feature units using a sub-feature generator trained to define the sub-feature units based on correlations within the feature.

22. A method comprising:

determining, for a particular training source speech sub-feature sequence, a corresponding training target speech sub-feature sequence;

training, using a processor, a conversion model using the corresponding sub-feature sequences to perform voice conversion of source speech to target speech using the trained conversion model; and training a sub-feature generator to divide feature data into sub-feature sequences.

* * * * *